US008485655B2

(12) United States Patent
Tormo et al.

(10) Patent No.: US 8,485,655 B2
(45) Date of Patent: Jul. 16, 2013

(54) INKJET-PRINTING MECHANISM CALIBRATION

(75) Inventors: Ana Maria Cardells Tormo, Barcelona (ES); Marina Ferran Farres, Barcelona (ES); Juan Uroz Soria, Terrassa (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 53 days.

(21) Appl. No.: 13/081,322

(22) Filed: Apr. 6, 2011

(65) Prior Publication Data

US 2012/0256982 A1 Oct. 11, 2012

(51) Int. Cl.
*B41J 2/01* (2006.01)

(52) U.S. Cl.
USPC ..... 347/102

(58) Field of Classification Search
USPC ..... 347/14–17, 19, 101, 102, 104
IPC ..... B41J 11/002
See application file for complete search history.

(56) References Cited

U.S. PATENT DOCUMENTS

| | | | | |
|---|---|---|---|---|
| 5,519,419 | A * | 5/1996 | Stephany et al. | 347/19 |
| 7,407,253 | B2 * | 8/2008 | Yokoyama et al. | 347/19 |
| 7,548,705 | B2 | 6/2009 | Morales et al. | |
| 7,571,974 | B2 | 8/2009 | Cowan et al. | |
| 7,731,324 | B2 * | 6/2010 | Nagashima | 347/19 |
| 7,800,779 | B2 | 9/2010 | Fan et al. | |
| 2005/0078140 | A1 | 4/2005 | Ono | |
| 2009/0009766 | A1 | 1/2009 | Bonino et al. | |

FOREIGN PATENT DOCUMENTS

WO 2009127261 A1 10/2009

* cited by examiner

*Primary Examiner* — An Do

(57) ABSTRACT

An ink patch is printed on a swath of media, by an inkjet-printing mechanism of an inkjet-printing device. Printing the ink patch takes a first length of time. The ink patch printed on the swath is heated at a first temperature less than a second temperature specified for the first length of time the inkjet-printing mechanism takes to print the ink patch. A second length of time is waited. A total length of time the swath is heated is at least substantially equal to the first length of time plus the second length of time.

15 Claims, 2 Drawing Sheets

INKJET-PRINTING MECHANISM CALIBRATION

BACKGROUND

An inkjet-printing device, such as an inkjet printer, forms an image on media like paper by ejecting ink onto the media. Examples of images include text, graphics, photos, and a combination thereof. To ensure optimal and accurate image formation, the inkjet-printing device may be occasionally calibrated.

DETAILED DESCRIPTION

Figure 1:
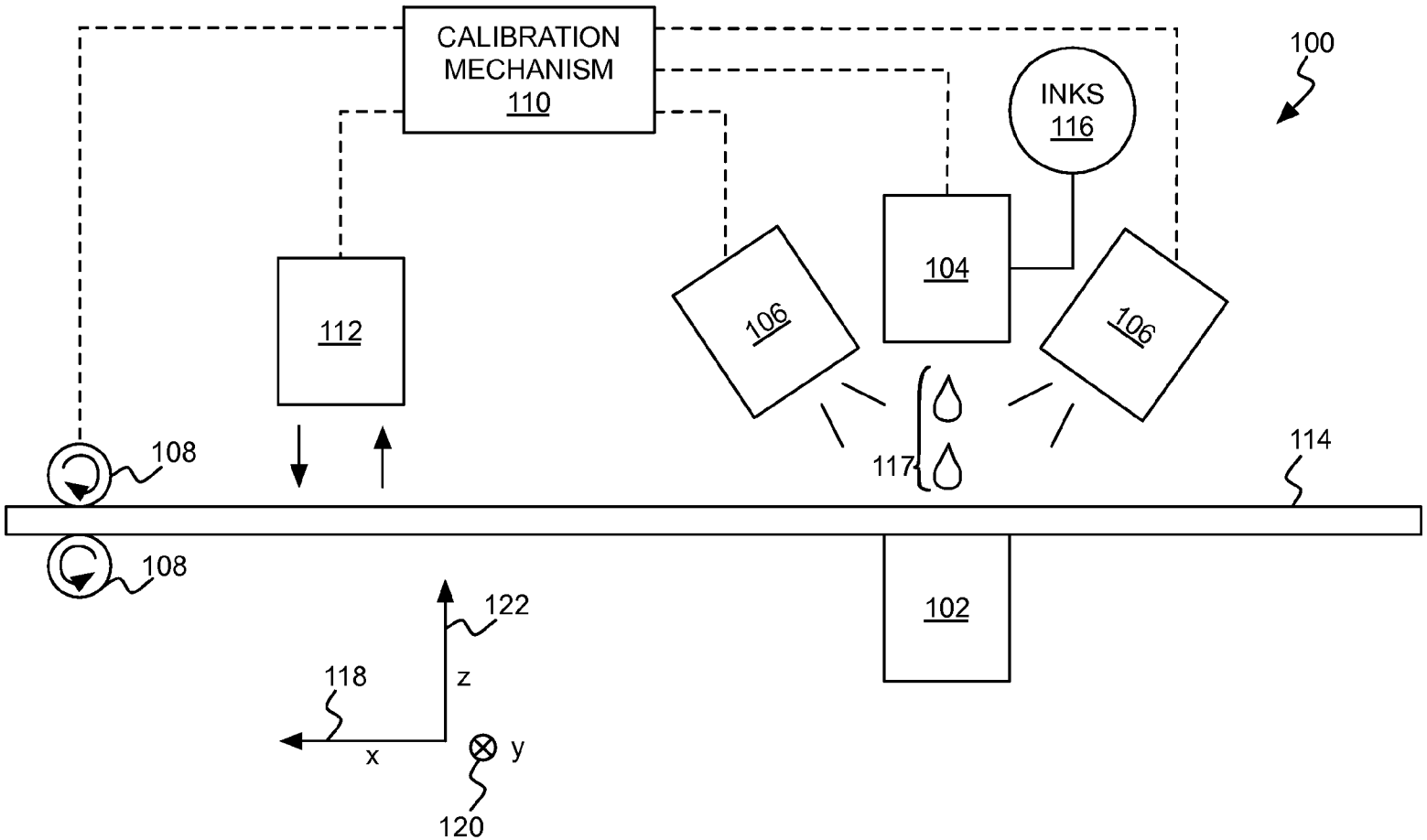
FIG. 1 is a diagram of an example inkjet-printing device.

As noted in the background section, to ensure optimal and accurate image formation by an inkjet-printing device like an inkjet printer, the device may be occasionally calibrated. There are different types of calibration that the inkjet-printing device can undergo, including printhead alignment, media advancement alignment, color calibration, and so on.

As an example of the latter, to ensure optimal color fidelity, one or more color patches may be printed by the inkjet-printing device. A color-measurement mechanism, such as a spectrophotometer, may then be employed to measure optical characteristics of the color patches. An inkjet-printing mechanism, like an inkjet printhead, of the inkjet-printing device may then have its printing parameters adjusted so that images are subsequently printed with better color fidelity.

However, such calibration is problematic for at least some types of inkjet-printing devices. For instance, certain types of inkjet-printing devices print with latex inks. Latex inks provide superior waterproofness of the images printed on media as compared to other types of inks, as well as other advantages. However, latex inks have to be cured at a relatively high temperature, such as 120 degrees Celsius (° C.), or more generally between 60-125° C., after they have been deposited onto media.

A problem that occurs when printing on some types of media with latex inks is that the media can deform while the latex inks are being cured. For example, the media may curl. While media curling may not be problematic during regular printing, color calibration may be deleteriously affected by such curling and other media deformation. This can be problematic for at least two reasons. First, when the color-measurement mechanism measures the media, the resulting measurement may have degraded color accuracy. Second, if the media has to be rewound to perform the color measurement, the curling of the media may result in the inkjet-printing mechanism coming into account with the media—causing a "head crash"—or the curling may not permit the color-measurement mechanism from not even being able to measure the media.

Disclosed herein are color-calibration techniques that can avoid these problems. An ink patch is printed on a swath of media, by an inkjet-printing mechanism. Printing the ink patch takes a first length of time. For instance, the inkjet-printing mechanism may be scanned over the swath a number of times to form the ink patch. The ink patch may be printed using a single color of ink of multiple colors of ink that are available to the inkjet-printing mechanism.

The swath is heated at a first temperature less than a second temperature that is ordinarily specified for the first length of time the inkjet-printing mechanism takes to print the ink patch. For instance, the second temperature may be specified in accordance with the number of times the inkjet-printing mechanism scans over the swath to form the ink patch. As one example, if a temperature of 120° C. is normally specified for ten-to-twelve passes of the inkjet-printing mechanism, a reduced temperature of 100° C. may instead be specified.

A second length of time is waited, either after the inkjet-printing mechanism has taken the first length of time to print the ink patch, or interleaved with the first length of time. As an example of the latter, after each pass of the inkjet-printing mechanism over the swath, a portion of the second length of time may be waited before the next pass occurs. As such, the total length of time that the swath is heated is at least substantially equal to the first length of time plus the second length of time.

For instance, the ink-jet printing mechanism may be scanned over the swath a number of times to form the ink patch, such that normally the media would be advanced after the inkjet-printing mechanism is finished printing the ink patch. However, waiting the second length of time means that the media is heated as if the inkjet-printing mechanism had been scanned over the swath a greater number of times. For example, the swath may be heated as if the inkjet-printing mechanism had been scanned over the swath twenty-to-twenty four times, instead of the ten-to-twelve times, say, that the inkjet-printing mechanism was actually scanned over the swath and ejecting ink.

The combination of heating the ink patch at a reduced temperature, and having the swath heated for at least the first and second lengths of time, has been found to avoid the problems described above. Printing the ink patch using just one color of ink can also assist in avoiding these problems. In other implementations, the ink patch may be printed using a combination of the colors of ink available to the inkjet-printing mechanism.

In the case of printing using latex inks, it has been found that these techniques reduce media deformation to an extent that subsequent optical characteristic measurements taken by a color-measurement mechanism are more accurate. These techniques have also been found to result in the color-measurement mechanism not coming into contact with the media, which improves reliability. Furthermore, these techniques have been found to decrease the number of times the color-measurement mechanism has to take measurements of the media.

FIG. 1 shows an example inkjet-printing device 100. The inkjet-printing device 100 is a device, such as a printer, which ejects ink onto media like paper to form images. More generally, the inkjet-printing device 100 is a fluid-ejection device that ejects fluid onto media. The inkjet-printing device 100 can include a platen 102, an inkjet-printing mechanism 104, a heating mechanism 106, a media-advancement mechanism 108, a calibration mechanism 110, and a measurement mechanism 112. The mechanisms 104, 106, 108, 110, and 112 can be considered as the various claimed means for performing their respective functionality. An x-axis 118, a y-axis 120, and a z-axis 122 are depicted in FIG. 1.

The media-advancement mechanism 108 moves or advances the media 114 along the x-axis 118 so that a portion of the media 114 is positioned against the platen 102. The portion of the media 114 that the inkjet-printing mechanism 104 can eject ink onto without the media 114 having to be advanced is referred to as a swath of the media 114. The media-advancement mechanism 108 can be or include one or more motors, rollers, and so on, and is under the control of the calibration mechanism 110.

The inkjet-printing mechanism 104 ejects different types of inks 116, such as different colors of inks 116, as drops 117 onto the current swath of the media 114 positioned against the platen 102. The inkjet-printing mechanism 104 can be or include on or more inkjet printheads, for instance. The inks 116 may be internal to or external from the inkjet-printing mechanism 104. The inkjet-printing mechanism 104 is more generally a fluid-ejection mechanism that ejects different types of fluids onto the current swath of the media 114. The inks 116 are more generally fluids.

As one example, the inkjet-printing mechanism 104 may be a scanning inkjet-printing mechanism, such as a scanning printhead, that can print onto just a portion of the current swath of the media 114 along the y-axis 120 at any one time. As such, the inkjet-printing mechanism 104 is scanned back and forth along the y-axis 120 so that the mechanism 104 can traverse at least substantially the entire width of the current swath along this axis. While the inkjet-printing mechanism 104 is scanning back and forth along the y-axis 120, the mechanism 104 ejects the drops 117 of the inks 116 onto the current swath. For instance, the inkjet-printing mechanism 104 may eject the drops 117 in a direction at least substantially parallel to the z-axis 122.

When the inkjet-printing mechanism 104 has finished ejecting ink on the current swath of the media 114, immediately or after a length of time has been waited, the media-advancement mechanism 108 advances the media 114 so that a new swath is positioned against the platen 102. However, as another example, the inkjet-printing mechanism 104 may be a stationary inkjet-printing mechanism, such as a page-wide printhead or a page-wide array of printheads. This type of inkjet-printing mechanism 104 is able to print onto at least substantially the entire width of the current swath along the y-axis 120 at least substantially at the same time, without having to scan over the swath.

The heating mechanism 106 heats a swath of the media 114, before, during, and/or after the inkjet-printing mechanism 104 has ejected ink onto this swath. The heating mechanism 106 can be or include one or more radiant and/or air blower-type heaters, among other types of heating mechanisms. The heating mechanism 106 may thus heat the swath in one or more of three different zones: a preprinting zone, a printing zone, and a curing zone.

The preprinting zone is a zone at which a swath of media 114 is positioned before the swath is advanced so that it is positioned against the platen 102, and thus before the inkjet-printing mechanism 104 prints ink onto this swath. The printing zone, which may also be referring to as a drying zone, is the zone in which the inkjet-printing mechanism 104 prints ink onto a swath of media 114, when this swath of media 114 is positioned against the platen 102. The curing zone is an additional zone at which the printed ink is also dried, or cured, with the heat from the heating mechanism 106. A swath of media 114 may be positioned within the curing zone after it has been advanced from the printing zone.

After a swath of the media 114 has been printed on with ink, the media 114 is advanced such that at some point this swath is incident to the measurement mechanism 112. As depicted in FIG. 1, the measurement mechanism 112 is positioned after the inkjet-printing mechanism 104 from the perspective of the direction in which the media 114 is advanced for printing on each swath of the media 114 to occur. However, the measurement mechanism 112 can be positioned elsewhere within the inkjet-printing device 100.

For example, the measurement mechanism 112 may be positioned on a same feature of the inkjet-printing device 100, such as a carriage, on which the inkjet-printing mechanism 104 is situated. In this case, a swath of media 114 may be heated in a preprinting zone, then advanced to a printing zone where the swath is printed on via the inkjet-printing mechanism 104 while still being heated, and finally advanced to a curing zone where the swath is still heated. Thereafter, the media 114 is rewound so that the swath of media 114 is again positioned within the printing zone so that the swath is incident to the measurement mechanism 112.

The measurement mechanism 112 measures optical characteristics and/or other characteristics of the ink printed on the swath. For instance, the measurement mechanism 112 may emit light onto the swath, and detect the light as reflected by the ink printed on the swath. The measurement mechanism 112 can be or include a spectrophotometer, another type of color-measurement mechanism, and/or another type of measurement mechanism altogether.

The calibration mechanism 110 can be implemented in software, hardware, or a combination of software and hardware. The calibration mechanism 110 controls the mechanisms 104, 106, 108, and 112. The calibration mechanism 110 may cause the inkjet-printing mechanism 102 to eject the drops 117 of the ink 116 onto a swath of the media 114 positioned against the platen 102, and may cause the heating mechanism 106 to cure these ink drops 117 by heating the swath. However, other features of the inkjet-printing device 100 may instead be responsible for at least some of the functionality that is ascribed herein to the calibration mechanism 110. For instance, a raster-image processor (RIP) may be responsible for causing the inkjet-printing mechanism 104 to eject ink onto a swath of media.

The calibration 110 then may cause the media-advancement mechanism 108 to advance the media 114 along the x-axis 118 until the swath in question is under the measurement mechanism 112, and may cause the measurement mechanism 112 to measure one or more characteristics of this swath. The calibration mechanism 110 can then adjust one or more parameters of the fluid-ejection mechanism 104 so that subsequently printed images by the fluid-ejection mechanism 104 are more optimal than if such calibration were not performed. Any type of calibration process is potentially amenable to performance by the calibration mechanism 110. Parameters of the fluid-ejection mechanism 104 that can be adjusted include firing frequency, drop size, number of drops, and so on.

Figure 2:
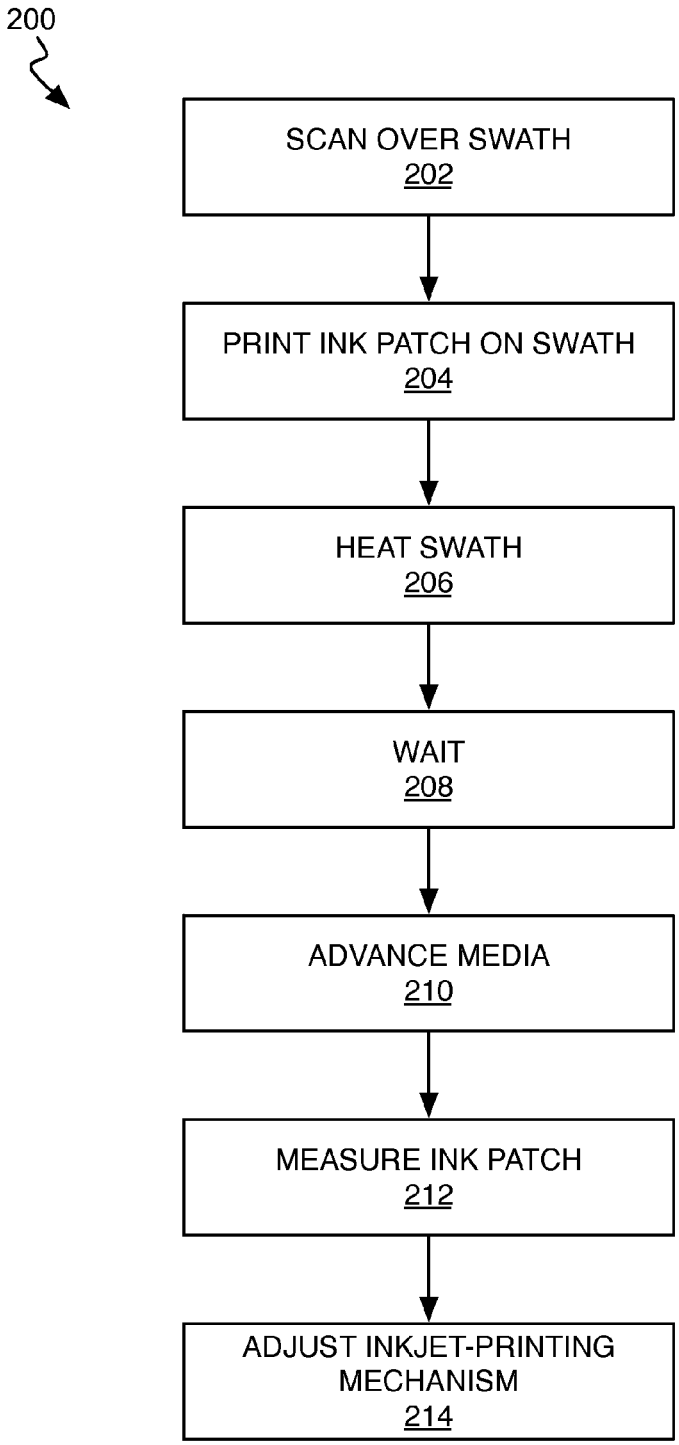
FIG. 2 is a flowchart of an example method for calibrating an inkjet-printing device.

FIG. 2 shows an example method 200 for calibrating the inkjet-printing mechanism 104 of the inkjet-printing device 100. If the inkjet-printing mechanism 104 is a scanning mechanism, the inkjet-printing mechanism 104 is scanned over a current swath of the media 114 positioned against the platen 102 (202). The inkjet-printing mechanism 104 prints an ink patch onto this swath (204), such as while the mechanism 104 is scanning over the swath.

Printing the ink patch takes a first length of time. Where the inkjet-printing mechanism 104 is a scanning mechanism, for instance, the inkjet-printing mechanism 104 scanning over the swath a number of times takes this first length of time. The ink patch may be printed using a single color, or type, of ink of the colors of inks 116 available to the inkjet-printing mechanism 104 for printing. For instance, if cyan, magenta, yellow, and black inks are available, the inkjet-printing mechanism 104 may just print cyan ink, magenta ink, yellow ink, or black ink to form the ink patch on the current swath. However, the ink patch may instead be printed using a combination of (i.e., more than one of) the different colors or types of inks 116 available to the inkjet-printing mechanism 104 for printing.

The swath is heated by the heating mechanism 106 at a first temperature (206) The first temperature is less than a second temperature that is ordinarily specified for the first length of time that it takes the inkjet-printing mechanism to print the ink patch. For instance, the second temperature may be specified for a particular number of times that the inkjet-printing mechanism 104 scans over the swath and ejects ink. The first temperature is thus less than this second temperature. Heating the ink patch can occur before, during and/or after formation of the ink path by the inkjet-printing mechanism 104 ejecting ink onto the swath.

In one particular example implementation, the ink patch may be dried at a temperature of 60° C., and then may ordinarily be cured at a temperature of 120° F. However, in accordance with this example implementation, the ink patch is still dried at the temperature of 60° C., but is instead cured at a temperature of 100° C. Thus, in this example implementation, the first temperature in question refers to the reduced curing temperature of 100° C., which is less than the ordinary curing temperature of 120° F.

A second length of time is also waited (208). Thereafter, the media 114 is advanced by the media-advancement mechanism 108 so that the swath in question is no longer positioned against the platen 102 and thus is no longer being heated by the heating mechanism (210). The total time the swath is heated is therefore at least substantially equal to sum of the first length of time that it takes the inkjet-printing mechanism 104 to print the ink patch and the second length of time that is waited.

For instance, ordinarily the swath may be heated for at least substantially just the first length of time it takes for the inkjet-printing mechanism 104 to form the ink patch on the swath, as may be dictated by the number of times the mechanism 104 has to pass over the swath to deposit the ink patch on the swath. The second length of time is waited, however, so that the total length of time that the swath is heated is greater than this first length of time. For instance, the total length of time that the swath is heated may be as if the inkjet-printing mechanism 104 had to pass a greater number of times over the swath to deposit the ink patch on the swath that the mechanism 104 actually did.

The second length of time may be waited in one of two different ways in an example implementation. First, after the inkjet-printing mechanism 104 has completely formed the ink patch on the swath, and is no longer scanning over the swath, the second length of time may then be waited. That is, the second length of time is waited after the first length of time has transpired. Second, the second length of time may be waited in an interleaved manner as to the first length of time. For example, after each pass or after each of a number of passes that the inkjet-printing mechanism 104 has performed over the swath, a portion of the second length of time can be waited.

The media 114 is advanced by the media-advancement mechanism 108 so that the swath on which the ink path has been printed is incident to the measurement mechanism 112. As noted above, the media-advancement mechanism 108 may rewind the media 114 where the measurement mechanism 112 is located along the x-axis 118 at the same position as (or even behind) the inkjet-printing mechanism 104. The measurement mechanism 112 measures the ink patch (212).

For instance, the measurement mechanism 112 may measure one or more optical characteristics of this ink patch. The calibration mechanism 110 then adjusts the inkjet-printing mechanism 104 (214) based on the ink patch as measured. For instance, the calibration mechanism 110 may adjust one or more printing or other parameters of the inkjet-printing mechanism 104 based on the measured optical characteristics of the ink patch. As such, calibration of the inkjet-printing mechanism 104 is completed.

As noted above, the inkjet-printing device 100 that has been described is a device, such as a printer, that ejects ink onto media, such as paper, to form images, which can include text, on the media. The inkjet-printing device 100 may further be or include a RIP. The inkjet-printing device 100 is more generally a fluid-ejection device, such as a fluid-ejection, precision-dispensing device that precisely dispenses fluid, such as ink, melted wax, or polymers. The device 100 may eject pigment-based ink, dye-based ink, another type of ink such as latex ink, or another type of fluid. Examples of other types of fluid include those having water-based or aqueous solvents, as well as those having non-water-based or non-aqueous solvents. However, any type of fluid-ejection, precision-dispensing device that dispenses a substantially liquid fluid may be used.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids thus include drugs, cellular products, organisms, fuel, and so on, which are not substantially or primarily composed of gases such as air and other types of gases, as can be appreciated by those of ordinary skill within the art.

We claim:

1. A method for calibrating an inkjet-printing mechanism of an inkjet-printing device, comprising:

printing an ink patch on a swath of media, by the inkjet-printing mechanism, where printing the ink patch takes a first length of time;

heating the swath at a first temperature less than a second temperature specified for the first length of time the inkjet-printing mechanism takes to print the ink patch; and, waiting a second length of time, such that a total length of time the swath is heated is at least substantially equal to the first length of time plus the second length of time.

2. The method of claim 1, further comprising advancing the media, after printing the ink patch and after waiting the second length of time.

3. The method of claim 1, further comprising:

scanning the inkjet-printing mechanism a number of times over the swath, where the inkjet-printing mechanism scanning over the swath the number of times takes the first length of time, wherein the inkjet-printing mechanism prints the ink patch on the swath while scanning over the swath the number of times, and wherein the first temperature at which the swath is heated is less than the second temperature specified for the number of times that the inkjet-printing mechanism scans over the swath of the media and prints the ink patch on the swath while scanning over the swath.

4. The method of claim 1, wherein printing the ink patch on the swath by the inkjet-printing mechanism comprises using a single color of ink of a plurality of colors of inks available to the inkjet-printing mechanism.

5. The method of claim 1, wherein waiting the second length of time is performed after printing the ink patch has finished.

6. The method of claim 1, wherein waiting the second length of time is interleaved with printing the ink patch.

7. The method of claim 1, further comprising:

measuring the ink patch, by a color-measurement mechanism of the inkjet-printing device; and, adjusting a parameter of the inkjet-printing mechanism based on the ink patch as measured.

8. A fluid-ejection device comprising:

a fluid-ejection mechanism to eject fluid onto a swath of media to form a patch on the swath;

a heating mechanism to heat the swath at a temperature less than a specified temperature for a first length of time the fluid-ejection mechanism takes to print the patch; and, a mechanism to wait a second length of time, such that a total length of time the swath is heated is at least substantially equal to the first length of time plus the second length of time.

9. The fluid-ejection device of claim 8, further comprising:

a media-advancement mechanism to move the media, after the fluid-ejection mechanism has formed the patch and after the second length of time has been waited.

10. The fluid-ejection device of claim 9, further comprising:

a measurement mechanism to measure an optical characteristic of the patch, wherein the mechanism is to adjust a parameter of the fluid-ejection mechanism based on the optical characteristic of the patch.

11. The fluid-ejection device of claim 8, wherein the mechanism is to wait the second length of time after the fluid-ejection mechanism has finished forming the patch.

12. The fluid-ejection device of claim 8, wherein the mechanism is to wait the second length of time interleaved with the fluid-ejection mechanism forming the patch.

13. The fluid-ejection device of claim 8, further comprising:

a scanning mechanism to scan the fluid-ejection mechanism a number of times over the swath, where the scanning the fluid-ejection mechanism the number of times takes the first length of time, wherein the fluid-ejection mechanism is to form the patch while being scanned the number of times over the swath;

and wherein the first temperature at which the patch formed on the swath is heated is less than the second temperature specified for the number of times that the fluid-ejection mechanism is to be scan over the swath of the media and is to form the patch while scanning over the swath.

14. The fluid-ejection device of claim 8, further comprising:

a plurality of different fluids, and wherein the fluid-ejection mechanism is to form the patch on the swath by using a single fluid of the plurality of fluids.

15. An inkjet-printing device comprising:

means for printing an ink patch on a swath of media;

means for heating the swath at a temperature less than a specified temperature for a first length of time the inkjet-printing mechanism takes to print the ink patch; and means for waiting a second length of time, such that a total length of time the swath is heated is at least substantially equal to the first length of time plus the second length of time.

* * * * *